US007388964B2

(12) United States Patent
Tomoeda et al.

(10) Patent No.: US 7,388,964 B2
(45) Date of Patent: Jun. 17, 2008

(54) LOUDSPEAKER, AND MODULE AND ELECTRONIC APPARATUS USING THE LOUDSPEAKER

(75) Inventors: Shigeru Tomoeda, Tsu (JP); Takanori Fukuyama, Matsusaka (JP); Masahide Sumiyama, Matsusaka (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 351 days.

(21) Appl. No.: 10/511,672

(22) PCT Filed: Jan. 27, 2004

(86) PCT No.: PCT/JP2004/000714

§ 371 (c)(1),
(2), (4) Date: Oct. 18, 2004

(87) PCT Pub. No.: WO2004/068899

PCT Pub. Date: Aug. 12, 2004

(65) Prior Publication Data

US 2006/0050922 A1 Mar. 9, 2006

(30) Foreign Application Priority Data

Jan. 31, 2003 (JP) ..... 2003-023772

(51) Int. Cl.
*H04R 9/06* (2006.01)
*H04R 7/00* (2006.01)

(52) U.S. Cl. ..... 381/412; 381/419; 381/421; 381/423

(58) Field of Classification Search ..... 381/396, 381/412, 419, 421, 423, 398, 420, 422, 431, 381/432; 181/171, 172
See application file for complete search history.

(56) References Cited

U.S. PATENT DOCUMENTS 6,188,774 B1 * 2/2001 Sabato et al. ..... 381/423
6,654,475 B2 * 11/2003 Nakaso ..... 381/396

FOREIGN PATENT DOCUMENTS

| | | | |
|---|---|---|---|
| JP | 59-193699 | | 11/1984 |
| JP | 5-191892 | | 7/1993 |
| JP | 11205897 A | * | 1/1998 |
| JP | 2000 201396 A | * | 1/1999 |
| JP | 2001-213161 | * | 7/2001 |
| JP | 2002-186092 | | 6/2002 |
| JP | 2002-526003 | | 8/2002 |
| JP | 2003-32786 | | 1/2003 |

* cited by examiner

*Primary Examiner*—Brian Ensey
(74) *Attorney, Agent, or Firm*—Steptoe & Johnson LLP

(57) ABSTRACT

A loudspeaker is provided that satisfies requirements for both a small size and a high sound pressure. In addition, the heat capacity of the magnetic circuit and the heat dissipation of the voice coil are improved in this loudspeaker. Using at least two pieces of bar magnets (21), an outer magnet type magnetic circuit is structured in which the magnetic gap comprising an upper plate (22) and a lower plate (23) has a straight section. Also, the configuration of the voice coil (28) is that of a track.

26 Claims, 7 Drawing Sheets

LOUDSPEAKER, AND MODULE AND ELECTRONIC APPARATUS USING THE LOUDSPEAKER

TECHNICAL FIELD

This invention relates to loud speakers to be used in various types of audio equipment and information and communications equipment.

BACKGROUND ART

In recent years, slim type loudspeakers are drawing attention in order to cope with requirements for miniaturization and higher sound pressure of mobile telephones.

Because of these requirements, much effort is being made to configure magnetic circuits into a rectangular shape in order to improve the space factor. Also, these magnetic circuits generally employ an internal magnet structure. Furthermore, many loudspeakers use magnets such as rare earth magnets having a large magnetic energy in order to cope with requirement for higher sound pressures.

Now, a description of a conventional internal magnet type loudspeaker will be given referring to FIG. 13.

FIG. 13 is a cross-sectional view of a conventional internal magnet type loudspeaker.

Magnetic circuit 4 is formed by sandwiching rectangular magnet 1 with yoke 3 and upper plate 2. Magnetic circuit 4 is press-fit into and joined with frame 6 while maintaining yoke 3 of magnetic circuit 4 in contact with frame 6.

When performing this process, an adhesive is coated on the surfaces of contact.

Subsequently, diaphragm 7 is bonded to the rim of frame 6 followed by coupling voice coil 8 to diaphragm 7 for driving it.

Voice coil 8 is held inside magnetic gap 5 in this way. Japanese Laid-Open Patent Application No. Sho 59-193699 discloses a planar driving type loudspeaker having a high magnetic conversion efficiency. This loudspeaker employs a magnet having a large magnetic energy and the magnetic circuit employs an internal magnet structure.

However, recent market requires increasingly higher sound pressures. The conventional loudspeakers as mentioned above already use magnets having a high magnetic energy and also employ an internal magnet type magnetic circuit structure. For this reason, improvement in the magnetic energy by improvement of magnet materials has already reached the limit. As a result, the only means left of attaining a higher sound pressure is improvement of the magnetic energy by increasing the volume of the magnet. In an internal magnet type magnetic circuit structure, in order to increase the volume of the magnet, it is necessary to increase the size of the voice coil or the height of the loudspeaker. This is against the market requirement for miniaturization. Accordingly, the conventional loudspeakers suffer problems of not being able to satisfy incompatible requirements of higher sound pressure and miniaturization.

The present invention addresses these problems and provides a loudspeaker that can cope with higher sound pressure requirement while maintaining a small size.

SUMMARY OF THE INVENTION

A loudspeaker is provided that comprises a frame coupled to a magnetic circuit formed by sandwiching two or more pieces of bar magnets between an upper plate and a lower plate, a diaphragm coupled to the perimeter of the frame, and a voice coil coupled to the diaphragm with a part of the diaphragm being disposed inside a magnetic gap of the magnetic circuit, where the voice coil has a shape of a track.

DETAILED DESCRIPTION OF PREFERRED EMBODIMENTS

Referring to drawings, a description of preferred embodiments of the present invention will be given in the following.

In the description of each of the preferred embodiments, descriptions of elements similar to those in Preferred Embodiment 1 will be omitted. Also, the drawings are schematic diagrams that do not represent dimensionally accurate positional relationships.

By the way, the word "track" as used in this invention means a course such as in an arena and represents a configuration consisting of straight sections and arc sections.

Preferred Embodiment 1

Figure 1:
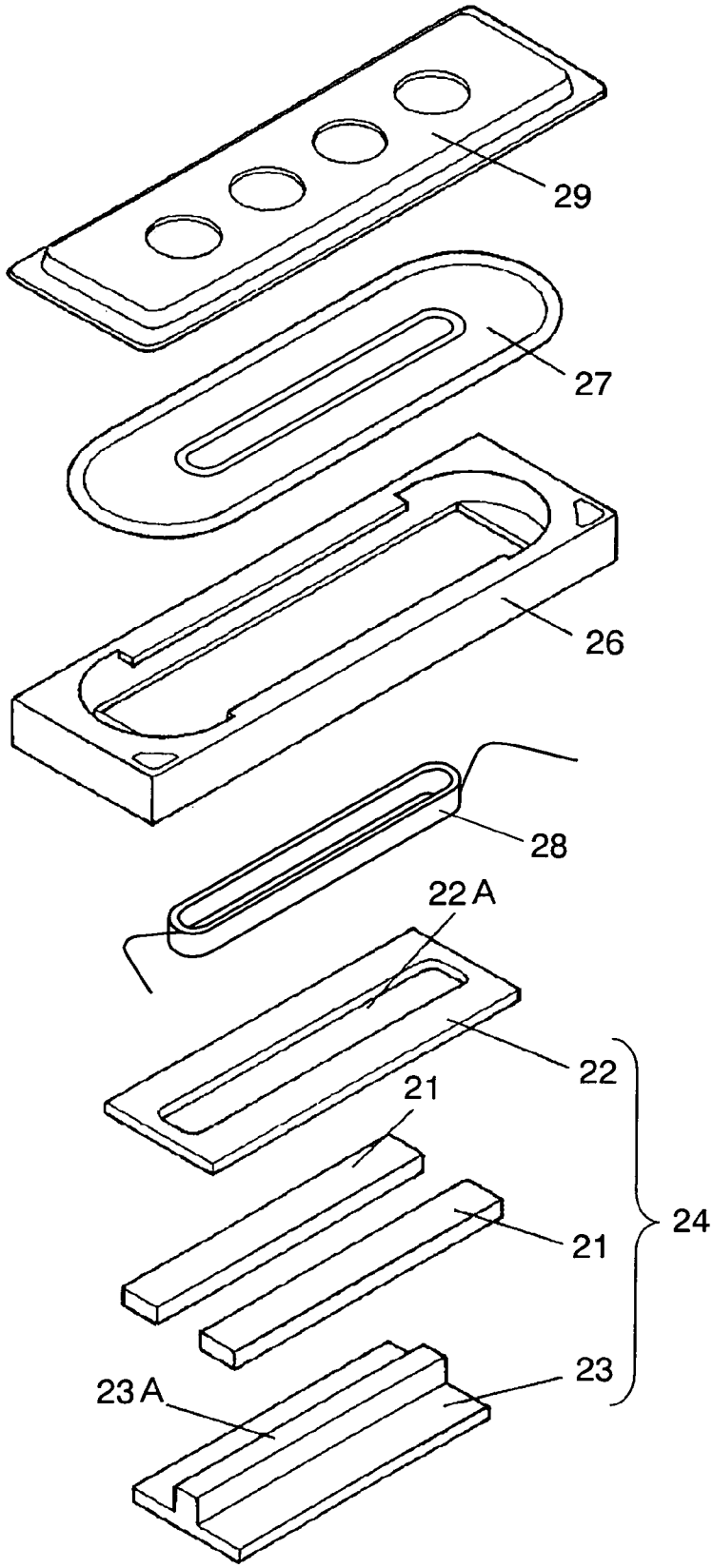
FIG. 1 is an exploded perspective view of a loudspeaker in Preferred Embodiment 1 of the present invention.
Figure 2:
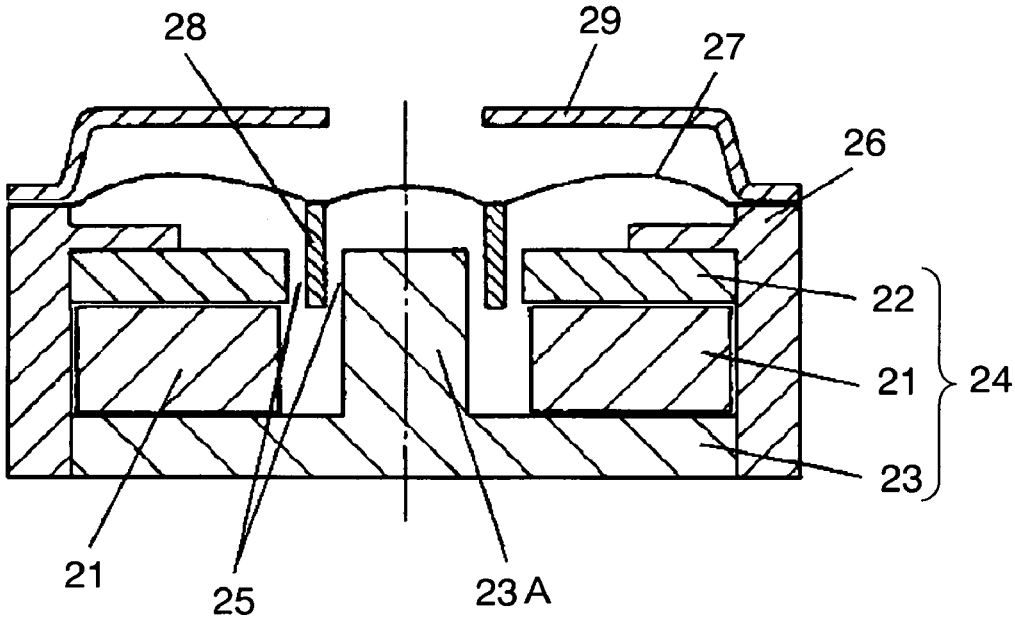
FIG. 2 is a cross-sectional view of a loudspeaker in Preferred Embodiment 1 of the present invention.
Figure 3:
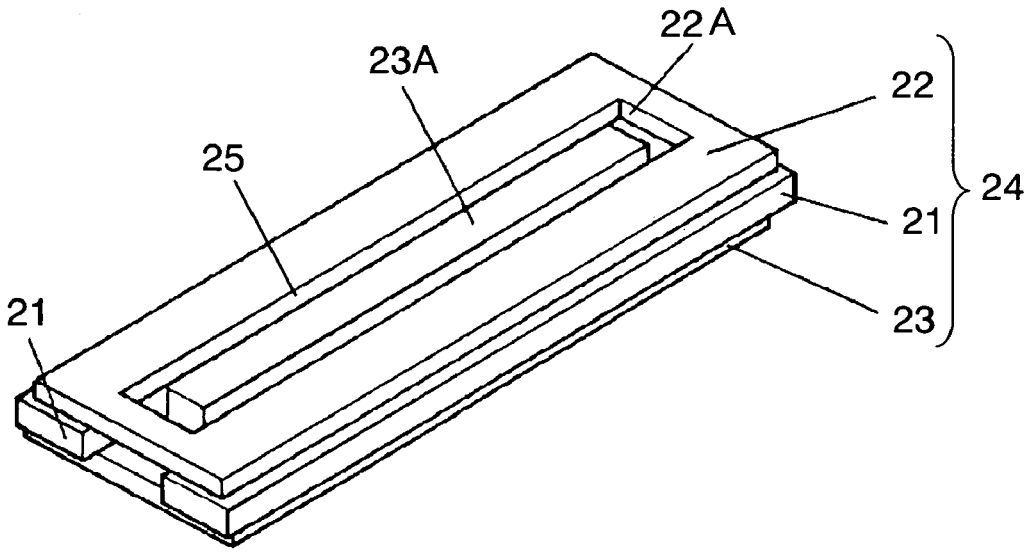
FIG. 3 is a perspective view of a magnetic circuit of a loudspeaker in Preferred Embodiment 1 of the present invention.

As shown in FIG. 1 to FIG. 3, magnetic circuit 24 is formed by supporting two pieces of bar magnets 21 between rectangular upper plate 22 and rectangular lower plate 23. As the magnets, rare-earth magnets having a high energy product such as neodymium-based magnets are preferably used.

A pair of magnets 21 are disposed in parallel in a manner sandwiching bar-shaped center pole section 23A provided on lower plate 23. Accordingly, center-pole section 23A is positioned inside rectangular magnetic gap window 22A of upper plate 22. Two parallel straight sections between center pole section 23A and upper plate 22 thus form magnetic gap 25. Frame 26 is coupled to magnetic circuit 24, and diaphragm 27 is coupled to the perimeter of frame 26.

And voice coil 28 is coupled to diaphragm 27.

A portion of voice coil 28 is disposed inside magnetic gap 25 of magnetic circuit 24. Protector 29 is coupled to the perimeter of frame 26 in a manner covering diaphragm 27. The configuration of voice coil is that of a track.

Frame 26 is made of resin such as ABS and PS. From the standpoint of heat resistance, polyphthal amide is preferably used. Here, the above-identified loudspeaker has two pieces of bar magnets 21 and has an outer magnet type magnetic circuit the magnetic gap 25 of which having straight sections. As a result, a large magnetic energy owing to plural magnets 21 is obtained while maintaining a small size by efficient use of space. In this way, a high sound pressure is realized. Also, by employing an outer magnet type magnetic circuit configuration, the volume of magnetic circuit 24 is increased and the heat capacity is increased, that is, heat capacity is improved. Furthermore, as ventilation of magnetic gap 25 from the lateral direction is secured, heat dissipation of voice coil 28 is improved.

Preferred Embodiment 2

Figure 4:
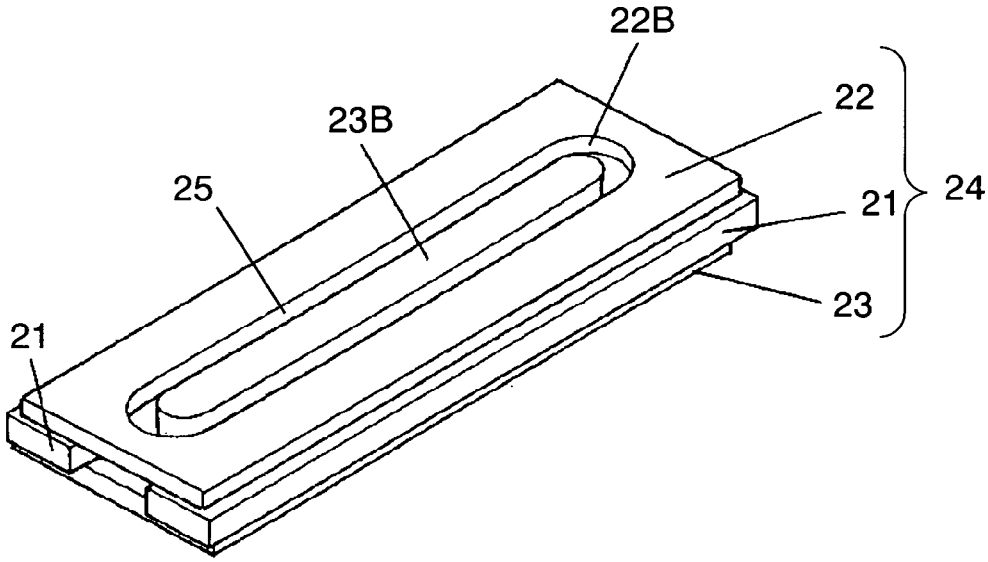
FIG. 4 is a perspective view of a magnetic circuit in Preferred Embodiment 2 of the present invention.

A description of Preferred Embodiment 2 will be given referring to FIG. 4. Magnetic circuit 24 is formed by supporting two pieces of bar magnets 21 between upper plate 22 having track-shaped magnetic gap window 22B and lower plate 23 having bar-like and track-shaped center pole 23B in a manner sandwiching.

This structure gives magnetic gap 25 a track-shaped configuration. And the voice coil has a track-shaped configuration. This configuration enables both further miniaturization owing to effective use of space and productivity improvement of the voice coil.

Here, productivity improvement of the voice coil means the following. That is, as the voice coil is wound in the shape of a track, the corners are round thus making winding easy and hence causing less failure such as a break in the wire, namely, higher productivity. Furthermore, when compared with a rectangular magnetic circuit, the magnetic flux distribution of a track-shaped magnetic circuit is uniform.

In addition, adoption of a track-shaped external configuration of the diaphragm is advantageous for miniaturization and is hence preferable.

The advantages with regard to magnetic energy and heat dissipation are the same as those of Preferred Embodiment 1.

Preferred Embodiment 3

Figure 5:
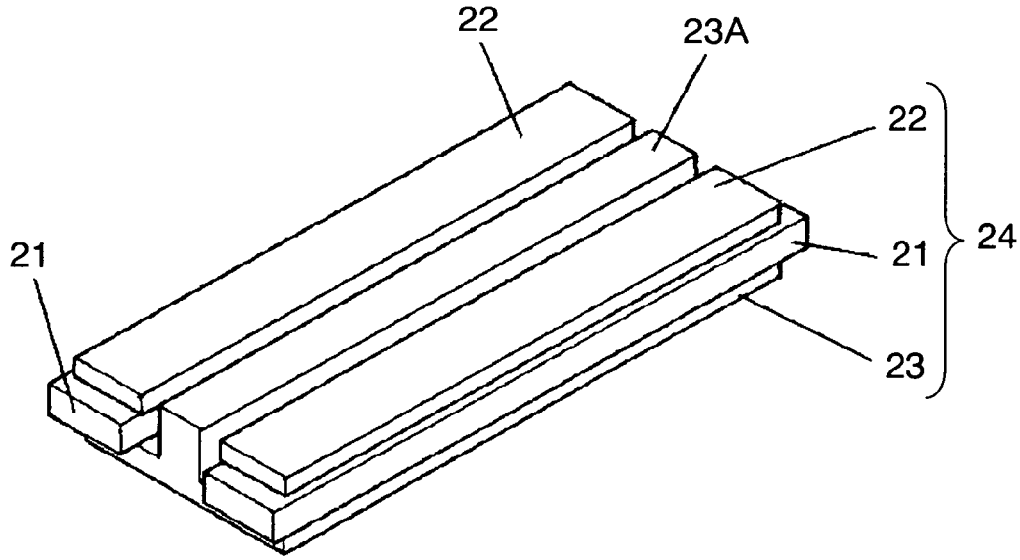
FIG. 5 is a perspective view of a magnetic circuit in Preferred Embodiment 3 of the present invention.

Referring to FIG. 5, a description of Preferred Embodiment 3 will be given. Magnetic circuit 24 is formed by supporting two pieces of bar magnets 21 between two pieces of bar-shaped upper plates 22 and lower plate 23.

In magnetic circuit 24, as two pieces of bar-shaped upper plates 22 are disposed in parallel, two straight-lined magnetic gap windows are formed. In this structure, it is not necessary to die-cut a metal to make an inner window in order to fabricate upper plate 22. As no waste material is produced, efficiency of utilization of the material is improved. Furthermore, no magnetic gap is formed on the ends of center pole section 23A of lower plate 23. As a result, the tolerance of relative positioning accuracy of center pole section 23A and upper plate 22 is higher than in other structure, that is, productivity can be improved.

In this preferred embodiment, too, the shape of the voice coil is that of a track. The advantages with regard to magnetic energy and heat dissipation are the same as those of Preferred Embodiment 1.

Preferred Embodiment 4

Figure 6:
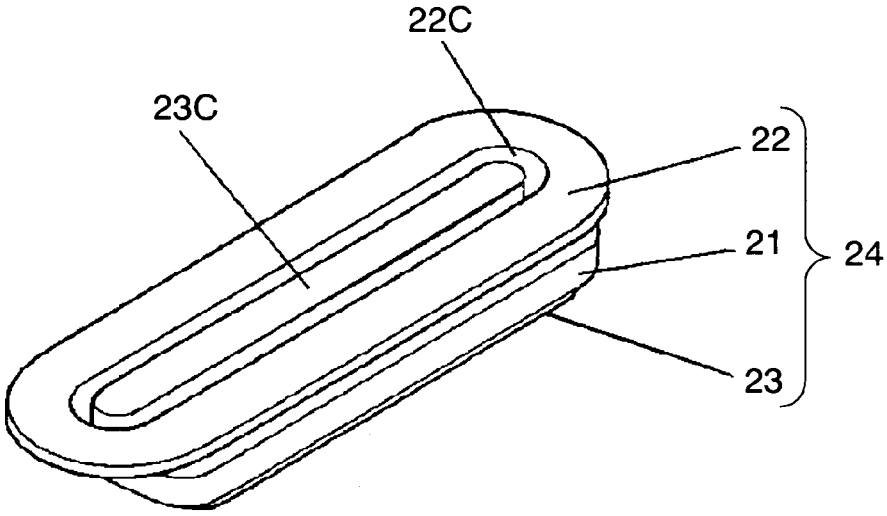
FIG. 6 is a perspective view of a magnetic circuit in Preferred Embodiment 4 of the present invention.

A description of Preferred Embodiment 4 will be given referring to FIG. 6. Magnetic circuit 24 is formed by supporting two pieces of bar magnets 21 between track-shaped upper plate 22 and lower plate 23.

Track-shaped center pole section 23C of lower plate 23 is located in track-shaped magnetic gap window 22C of upper plate 22. With this structure, the space factors of magnetic circuit 24 relative to diaphragm 27 and frame 26 can be improved.

The advantages with regard to magnetic energy and heat dissipation are the same as those of Preferred Embodiment 1.

Preferred Embodiment 5

Figure 7:
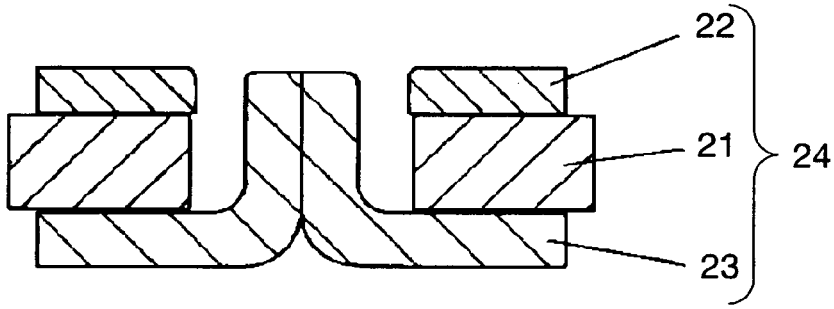
FIG. 7 is a cross-sectional view of a magnetic circuit in Preferred Embodiment 5 of the present invention.

A description of Preferred Embodiment 5 will be given referring to FIG. 7. Magnetic circuit 24 is formed by supporting two pieces of bar magnets 21 between upper plate 22 and lower plate 23 that has been divided in the vertical direction.

Lower plate 23 is fabricated by joining two pieces of rectangular plates that have been bent. Employment of this structure enables fabrication of lower plate 23 through processes of punching a sheet material with a die and bending. As a result, the efficiency of material utilization and productivity of magnetic circuit 24 can be improved. The advantages with regard to magnetic energy and heat dissipation are the same as those of Preferred Embodiment 1.

Preferred Embodiment 6

Figure 8:
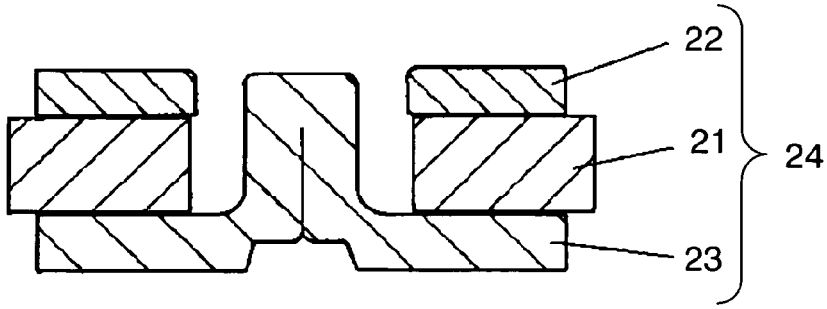
FIG. 8 is a cross-sectional view of a magnetic circuit in Preferred Embodiment 6 of the present invention.

Referring to FIG. 8, a description of Preferred Embodiment 6 will be given. Magnetic circuit 24 is formed by supporting two pieces of bar magnets 21 between upper plate 22 and lower plate 23 fabricated by bending a sheet of metal. With this structure, the efficiency of material utilization and productivity of magnetic circuit 24 can be improved. As the metal, a sheet of rolled steel and the like is used. The advantages with regard to magnetic energy and heat dissipation are the same as those of Preferred Embodiment 1.

Preferred Embodiment 7

Figure 9:
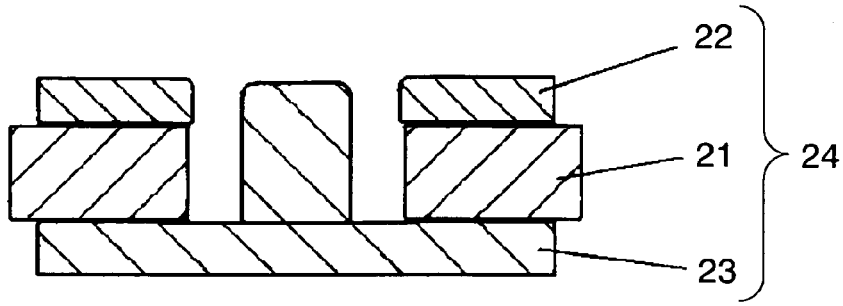
FIG. 9 is a cross-sectional view of a magnetic circuit in Preferred Embodiment 7 of the present invention.

Referring to FIG. 9, a description of Preferred Embodiment 7 will be given. Magnetic circuit 24 is formed by supporting two pieces of bar magnets 21 between upper plate 22 and lower plate 23 that has been divided in the direction of the thickness.

Lower plate 23 is made by joining a bar-shaped plate having a rectangular cross-section onto a flat plate. With this structure, the efficiency of material utilization and productivity of magnetic circuit 24 can be improved.

The advantages with regard to magnetic energy and heat dissipation are the same as those of Preferred Embodiment 1.

Preferred Embodiment 8

Figure 10:
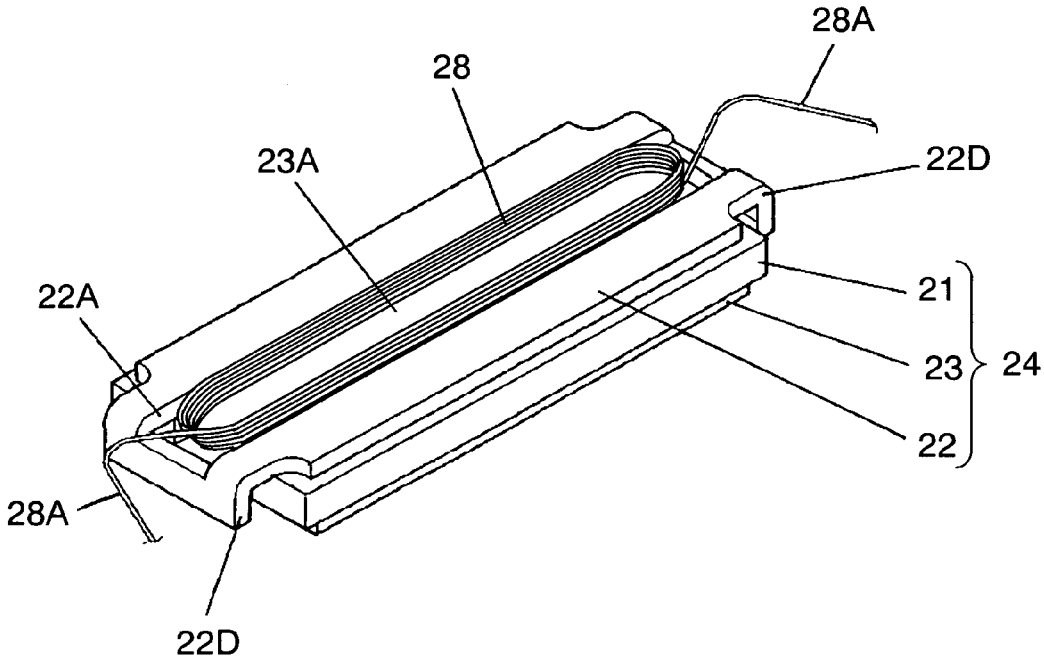
FIG. 10 is a perspective view of a magnetic circuit in Preferred Embodiment 8 of the present invention.

Referring to FIG. 10, a description of Preferred Embodiment 8 will be given. Level differences are formed on upper plate 22 of magnetic circuit 24 by providing, on both ends in the direction of the length, bent portions 22D that include a magnetic window.

Magnetic circuit 24 is formed in a manner such that lead wire 28A of voice coil 28 can be taken out from a gap between the level difference and a frame. With this structure, interference due to lead wire of voice coil can be prevented. In this way, reliability and productivity can be improved.

As voice coil has a shape of a track, it is preferable that the shape of the magnetic gap be also that of a track.

The advantages with regard to magnetic energy and heat dissipation are the same as those of Preferred Embodiment 1.

Preferred Embodiment 9

Figure 11:
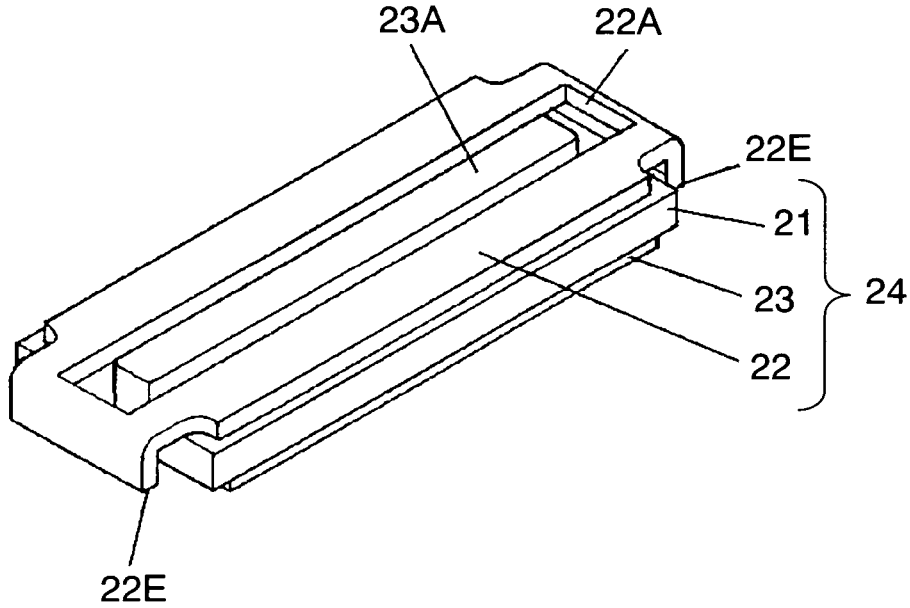
FIG. 11 is a perspective view of a magnetic circuit in Preferred Embodiment 9 of the present invention.

Referring to FIG. 11, a description of Preferred Embodiment 9 will be given. Upper plate 22 of magnetic circuit 24 is formed by bending a metal sheet. Necessary functions such as positioning guide 22E and reinforcement rib are then provided. With this structure, productivity of the magnetic circuit and the strength of upper plate can be improved, and deformation of upper plate during surface treatment can be prevented. Other advantages are the same as those of Preferred Embodiment 1. Here, as sheet-form rolled steel can be used as the metal, this structure also gives advantage from the material cost standpoint.

As voice coil has a shape of a track, it is preferable that the shape of the magnetic gap be also of a shape of a track.

The advantages with regard to magnetic energy and heat dissipation are the same as those of Preferred Embodiment 1.

Preferred Embodiment 10

Figure 12:
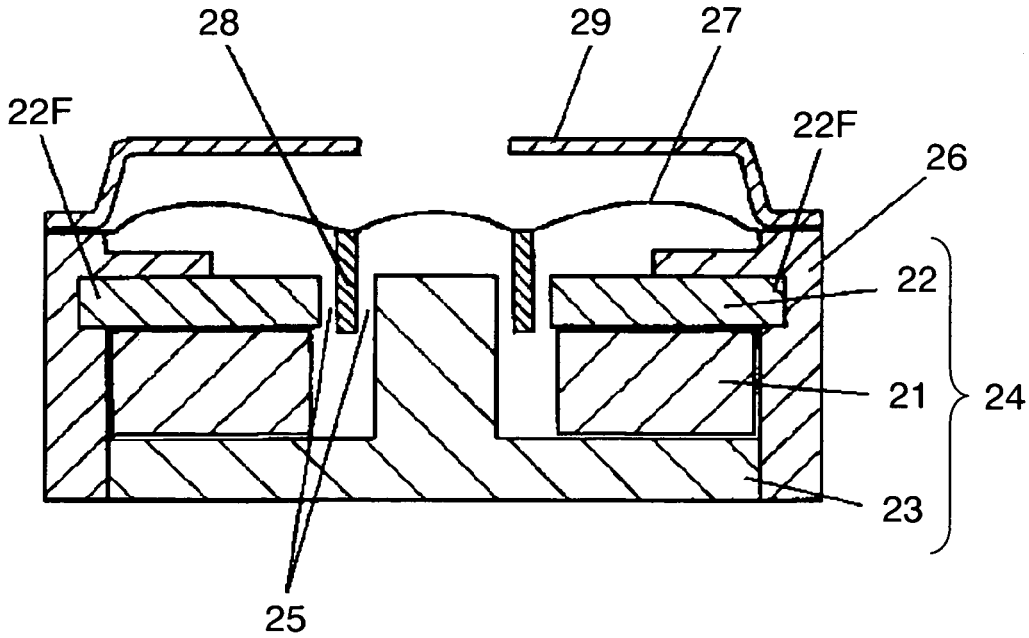
FIG. 12 is a cross-sectional view of a loudspeaker in Preferred Embodiment 10 of the present invention.
Figure 13:
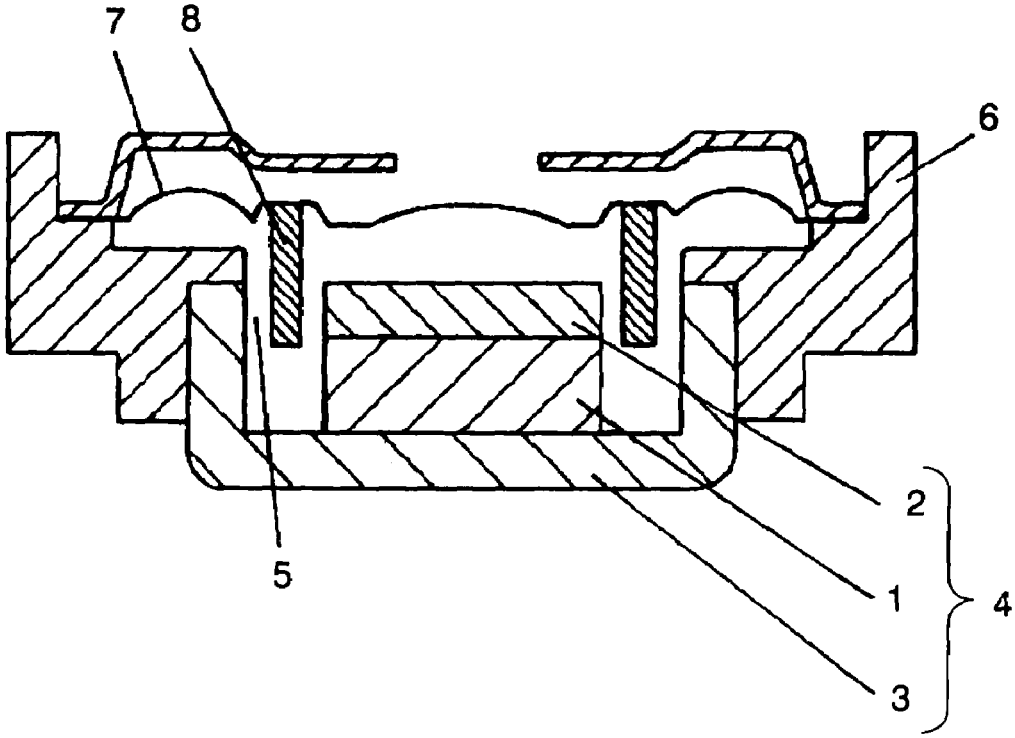
FIG. 13 PRIOR ART
FIG. 13 is a cross-sectional view of a conventional loudspeaker.

Referring to FIG. 12, a description of Preferred Embodiment 10 will be given. Protrusion 22F is provided on the perimeter of upper plate 22, and frame 26 is injection molded (insert molding) with protrusion 22F buried. Upper plate 22 is coupled to frame 26 in this way. In view of heat resistance reliability, polyphthal amide is preferable as the resin material to be used.

With this structure, productivity and reliability of a loudspeaker can be improved. The advantages with regard to magnetic energy and heat dissipation are the same as those of Preferred Embodiment 1.

INDUSTRIAL APPLICABILITY

As has been described above, the loudspeaker of the present invention has an outer magnet type magnetic circuit having at least two pieces of bar magnets and a voice coil in the shape of a track. As a result, as a high magnetic energy is obtainable by the use of two or more pieces of magnets while maintaining a small size by efficient use of the space, a high sound pressure can be realized.

Also, by the outer magnet type magnetic circuit structure, improvement in the heat capacity of the magnetic circuit and improvement in the heat dissipation of the voice coil can be realized.

In summary, a high performance and high productivity loudspeaker is obtainable. Furthermore, modules that combine a loudspeaker of the present invention and an electronic circuit, and electronic apparatuses that are equipped with a loudspeaker of the present invention can be provided.

The invention claimed is:

1. A loudspeaker comprising:

a magnetic circuit including:

at least two parallel bar magnets located between an upper plate and a lower plate, and a bar-shaped pole piece parallel to and located between the bar magnets, the bar magnets, the upper plate, the lower plate, and the pole piece forming an outer magnet type magnetic circuit;

a frame coupled to the magnetic circuit;

a diaphragm coupled to a perimeter of the frame; and a voice coil having a portion located in a magnetic gap of the magnetic circuit, the voice coil having a shape of a track, wherein a part of the upper plate includes different levels, and a lead wire of the voice coil extends from a gap between the level difference and the frame.

2. The loudspeaker of claim 1, wherein the configuration of the magnetic gap is that of a track.

3. The loudspeaker of claim 1, wherein the outer configuration of the magnetic circuit is that of a track.

4. The loudspeaker of claim 1, wherein the external configuration of the diaphragm is that of a track.

5. The loudspeaker of claim 1, wherein the magnetic gap at least has a straight section.

6. The loudspeaker of claim 1, wherein the magnetic circuit comprises a divided upper plate.

7. The loudspeaker of claim 1, wherein the magnetic circuit comprises the lower plate divided in the vertical direction.

8. The loudspeaker of claim 1, wherein the lower plate comprises a bent metal sheet.

9. The loudspeaker of claim 1, wherein the magnetic circuit comprises the lower plate divided in the direction of the thickness.

10. The loudspeaker of claim 1, wherein the upper plate comprises a bent metal sheet.

11. A module that comprises the loudspeaker of claim 1 and an electronic circuit.

12. An electronic apparatus equipped with the loudspeaker of claim 1.

13. The loudspeaker of claim 1 wherein the lower plate is the bar-shaped pole piece.

14. A loudspeaker comprising:

a magnetic circuit including:

at least two parallel bar magnets located between an upper plate and a lower plate, and a bar-shaped pole piece parallel to and located between the bar magnets, the bar magnets, the upper plate, the lower plate, and the pole piece forming an outer magnet type magnetic circuit;

a frame coupled to the magnetic circuit;

a diaphragm coupled to a perimeter of the frame; and a voice coil having a portion located in a magnetic gap of the magnetic circuit, the voice coil having a shape of a track, wherein the upper plate and the lower plate are coupled by a protrusion on a perimeter of the upper plate that extends into the injection molded frame.

15. The loudspeaker of claim 14, wherein the configuration of the magnetic gap is that of a track.

16. The loudspeaker of claim 14, wherein the outer configuration of the magnetic circuit is that of a track.

17. The loudspeaker of claim 14, wherein the external configuration of the diaphragm is that of a track.

18. The loudspeaker of claim 14, wherein the magnetic gap at least has a straight section.

19. The loudspeaker of claim 14, wherein the magnetic circuit comprises a divided upper plate.

20. The loudspeaker of claim 14, wherein the magnetic circuit comprises the lower plate divided in the vertical direction.

21. The loudspeaker of claim 14, wherein the lower plate comprises a bent metal sheet.

22. The loudspeaker of claim 14, wherein the magnetic circuit comprises the lower plate divided in the direction of the thickness.

23. The loudspeaker of claim 14, wherein the upper plate comprises a bent metal sheet.

24. A module that comprises the loudspeaker of claim 14 and an electronic circuit.

25. An electronic apparatus equipped with the loudspeaker of claim 14.

26. The loudspeaker of claim 14 wherein the lower plate is the bar-shaped pole piece.

* * * * *